US010576321B2

(12) United States Patent
Solana

(10) Patent No.: US 10,576,321 B2
(45) Date of Patent: Mar. 3, 2020

(54) IN-GROUND TRAMPOLINE SYSTEM

(71) Applicant: Joseph Solana, Doylestown, PA (US)

(72) Inventor: Joseph Solana, Doylestown, PA (US)

( * ) Notice: Subject to any disclaimer, the term of this patent is extended or adjusted under 35 U.S.C. 154(b) by 21 days.

(21) Appl. No.: 15/847,836

(22) Filed: Dec. 19, 2017

(65) Prior Publication Data

US 2018/0169453 A1 Jun. 21, 2018

Related U.S. Application Data

(60) Provisional application No. 62/435,988, filed on Dec. 19, 2016.

(51) Int. Cl.

| | |
|---|---|
| ***A63B 5/11*** | (2006.01) |
| ***A63B 71/00*** | (2006.01) |
| ***E02B 11/00*** | (2006.01) |
| ***A63B 21/02*** | (2006.01) |

(52) U.S. Cl.

CPC ..... *A63B 5/11* (2013.01); *A63B 71/0054* (2013.01); *E02B 11/00* (2013.01); *A63B 21/023* (2013.01); *A63B 2071/009* (2013.01); *A63B 2071/0063* (2013.01); *A63B 2209/10* (2013.01)

(58) Field of Classification Search

CPC ..... A63B 5/11; A63B 71/0054; A63B 21/023; A63B 2209/10; A63B 2071/0063; A63B 2071/009; E02B 11/00

See application file for complete search history.

(56) References Cited

U.S. PATENT DOCUMENTS

| | | | | |
|---|---|---|---|---|
| 3,648,301 | A * | 3/1972 | Wiley | E04H 4/0018 4/506 |
| 6,712,554 | B1 * | 3/2004 | Froehly | E02B 11/005 405/36 |
| 7,131,239 | B2 * | 11/2006 | Williams | E02D 27/14 52/169.5 |
| 7,691,032 | B2 * | 4/2010 | Burnham | A63B 5/11 482/27 |
| 9,358,412 | B2 * | 6/2016 | Nelson | A63B 5/11 |
| 2005/0054485 | A1 * | 3/2005 | McDermott | A63B 5/11 482/27 |
| 2014/0342880 | A1 * | 11/2014 | Nelson | A63B 5/11 482/27 |
| 2018/0169453 | A1 * | 6/2018 | Solana, Jr. | A63B 5/11 |

* cited by examiner

*Primary Examiner* — Gary D Urbiel Goldner

(74) *Attorney, Agent, or Firm* — Douglas J. Ryder; Ryder, Mazzeo & Konieczny LLC

(57) ABSTRACT

An in-ground trampoline includes a plurality of walls designed to be connected together to act as a frame for the trampoline as well as act as a retaining wall for the hole the trampoline is located within. The walls are placed within the hole so a bounce mat of the trampoline is substantially flush with the ground. The walls receive springs that secure to the bounce mat and support the bounce mat at the appropriate height. The walls receive safety pads that will cover the upper edge of the walls and the springs for safety. The hole, interior to the walls, has a seepage pit formed therein for drainage. The hole may be deeper interior to the walls and the seepage pit may be located therewithin. The walls include lower platforms that extend outward and the lower platforms are backfilled over to provide support for the walls.

17 Claims, 8 Drawing Sheets

IN-GROUND TRAMPOLINE SYSTEM

BACKGROUND

Modern trampolines were initially developed as training tools for gymnastic tumbler athletes in the 1930s, since then expanding to be involved in a wide variety of competitive and recreational activities. Competitors have adapted sports to play on trampolines and have even established the sport of trampolining in the Olympics. Trampolines have also become ubiquitous in training astronauts, acrobats, divers, and skiers. Many people also use trampolines for play and casual exercise, with recreational trampolines being a popular fixture outside in yards and gardens.

Modern recreational trampolines generally consist of a frame, a bounce mat, a plurality of springs, and a frame pad, and are most often circular, rectangular, or octagonal in shape. They are often installed above ground level, wherein the bottom of the trampoline frame simply rests on the ground surface so that the bounce mat is located several feet in the air. To prevent the wind from blowing the trampoline away the frame is typically secured to the ground in some fashion.

Sometimes they are installed below ground level by inserting the trampoline frame into a pit or trench. In-ground, or sunken, trampolines have benefits over above ground trampolines. As a majority of an in-ground, or sunken, trampoline may hidden below ground, and you may be able to obscure from view the rest, they are less of a visual and spacial imposition. They are easier to use, especially for children, in that they obviate the need for ladders, jumping, climbing, or having to be lifted unto the bounce mat, in contrast to an above-ground trampoline. They are safer, in that they reduce the falling distance to the ground and minimize the possibilities of hitting the metal frame of the trampoline. They are easier to keep free from wear and to secure against theft and strong wind.

In-ground trampolines are basically standard above-ground trampolines only slightly adapted for in-ground installation. The adapting may be a frame with a lower height by the addition of one or more separately attachable retaining walls to the frame of the trampoline. The retaining walls are to keep the surrounding earth from getting underneath the trampoline as the bounce mat needs to be above the ground below it to operate. Other than the addition of the retaining walls, in-ground trampolines do not vary in construction or assembly, and are not specifically adapted to be installed below ground.

The retaining walls utilized for current in-ground trampolines are designed as separate add on components to a standard trampoline. This adds to the cost and the number of components required. Furthermore, retaining walls designed to be attached to a frame may not provide adequate structural integrity in the long run. Moreover, trampolines installed in pits in the ground may be susceptible to issues associated with standing or running water within the pit including rusting of the frame, soil erosion and/or becoming a breeding ground for mosquito's or the like.

What is needed is an in-ground trampoline that retains its advantages over above-ground trampolines that is specifically designed and configured to be installed below ground level to provide adequate support for the bounce mat, structural integrity for the pit walls and drainage of the pit. The specially designed in-ground trampoline is optimized for long-term use and enjoyment over current in-ground trampolines.

BRIEF DESCRIPTION OF THE DRAWINGS

The features and advantages of the various embodiments will become apparent from the following detailed description in which.

DETAILED DESCRIPTION

An in-ground trampoline that includes a plurality of walls that are specifically designed to be connected together to act as a frame for the trampoline as well as act as a retaining wall for the hole the trampoline is located within. The walls are configured to be connected together in the size and shape of the trampoline. The walls are configured to receive springs that secure to a bounce mat and support the bounce mat at the appropriate height. The walls may be configured to receive safety pads that will cover the upper edge of the walls and the springs for safety. The walls are configured to be located in proximity to sides of a hole that the trampoline is placed in, in order to maintain the integrity of the hole.

The walls are to be placed within the hole so that at least a portion of the frame created from the walls is located therewithin. It is anticipated that the trampoline will be installed so that the bounce mat is substantially flush with the ground (or at least a portion of the ground if the trampoline is to be installed on a sloped surface). However, the invention is in not limited thereto. For example, the walls may be paced in the hole so that a majority of the frame is within the ground but that the bounce mat is a small distance above the ground. The small distance that the walls are above the ground may provide venting for the trampoline as if the air cannot escape it will limit the bouncing provided by the bounce mat.

Figure 1A:
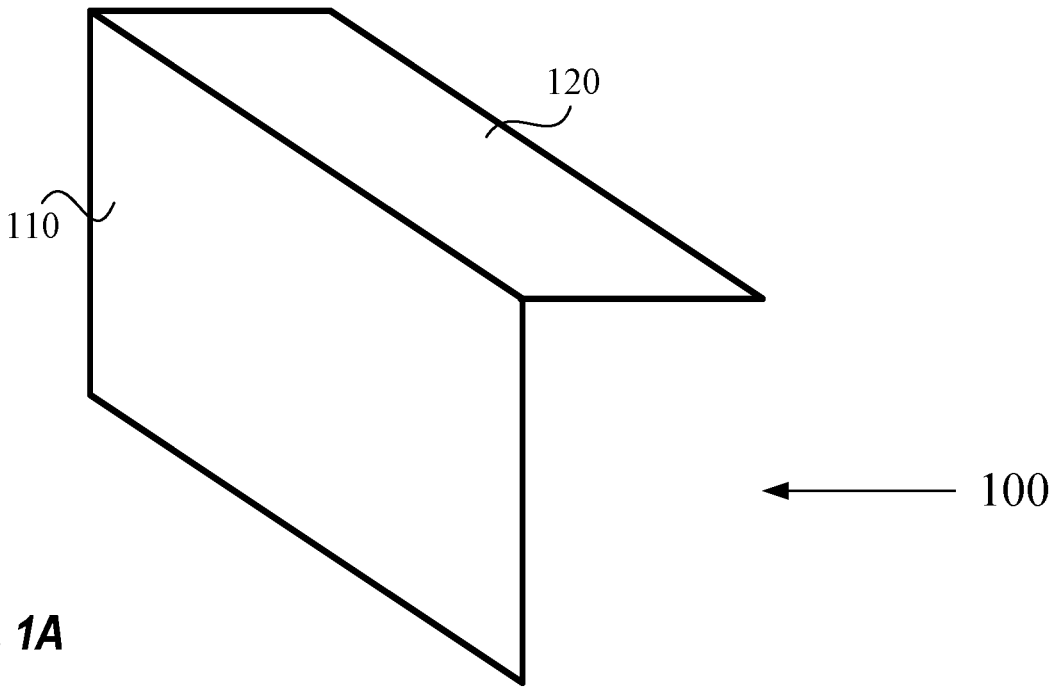
FIGS. 1A-1F illustrate perspective views of several different example straight walls that can be utilized to create a frame and retaining wall for an in-ground trampoline, according to various embodiments.

FIG. 1A illustrates a perspective view of an example wall 100 to be utilized to create an in-ground trampoline. The wall 100 is illustrated as being a straight wall but is in no way intended to be limited thereby. Rather, the walls may have various sizes and shapes so that different size and shape trampolines can be provided. For example, all straight walls may be utilized to form square or rectangle shaped trampolines, all curved walls may be utilized to form circle shaped trampolines, and a combination of straight and curved walls may be utilized to form oval shaped trampolines.

The wall 100 includes a main vertical wall (side wall) 110 and an upper platform 120 that extends substantially perpendicular from the side wall 110. The side wall 110 provides the height for which the bounce mat will be above the ground (the depth to which the hole should be dug). The upper platform 120 is to extend away from the interior of the hole. According to an embodiment where the top of the trampoline is flush with the ground, the upper platform 120 is designed to be substantially level with the ground (lay on top of the ground). The upper platform 120 is also designed to receive a frame pad that covers the upper platform 120 and the springs that connect to the walls (frame) and the bounce mat.

The wall 100 is to be made of materials that are sturdy enough to maintain the integrity of the hole, to receive the springs and to support the bounce mat that will be connected thereto and the tension of users bouncing on the bounce mat. Furthermore, the wall 100 is to be made of materials that can handle outdoor use (e.g., weather resistant, rust resistant). The wall 100 should be made of materials that provide the appropriate sturdiness and resistance to corrosion, wear, and rust. According to one embodiment, the wall 100 may be made of metal (e.g., stainless steel). According to one embodiment, the wall 100 may be made of plastics, composites or some combination thereof.

According to one embodiment, the wall 100 is created from a single piece (e.g., single sheet of metal) that is cut and bent into the appropriate form (e.g., bent to form the upper platform 120). According to one embodiment, the single piece may need to have slots (not illustrated) cut in an upper edge thereof to enable the upper edge to be bent to form the upper platform 120.

Figure 1B:
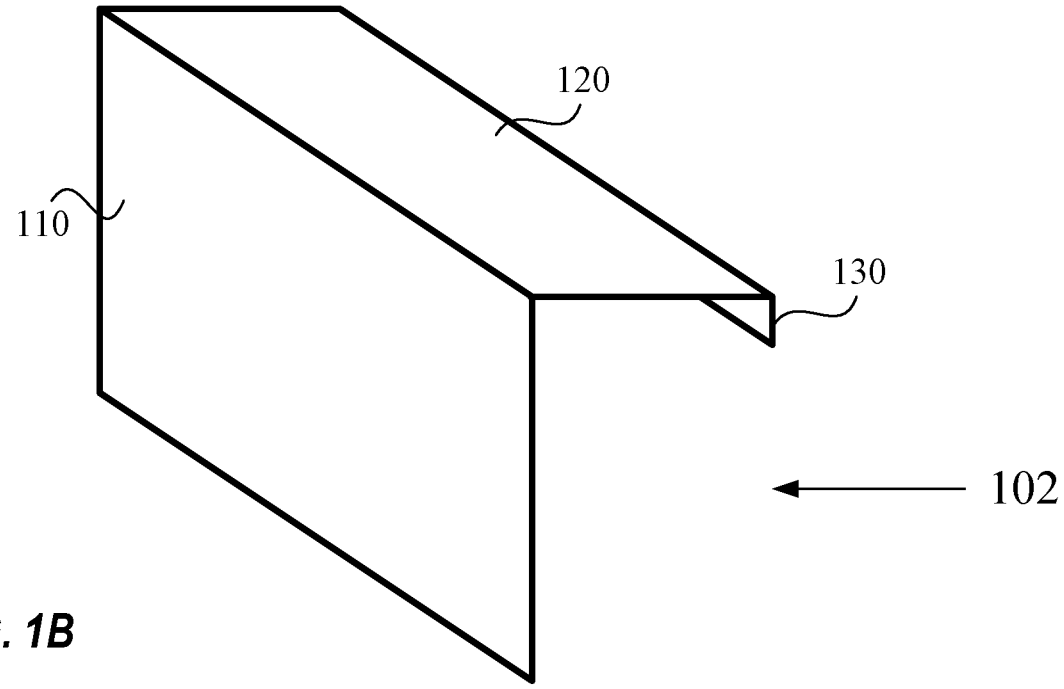

FIG. 1B illustrates a perspective view of an example wall 102. The wall 102 is similar to the wall 100 but includes a flange 130 that extends downward from a far edge of the upper platform 120. The flange 130 may be to, for example, secure additional support thereto if required (e.g., to support outer edge of upper platform 120 if slots are cut).

Figure 1C:
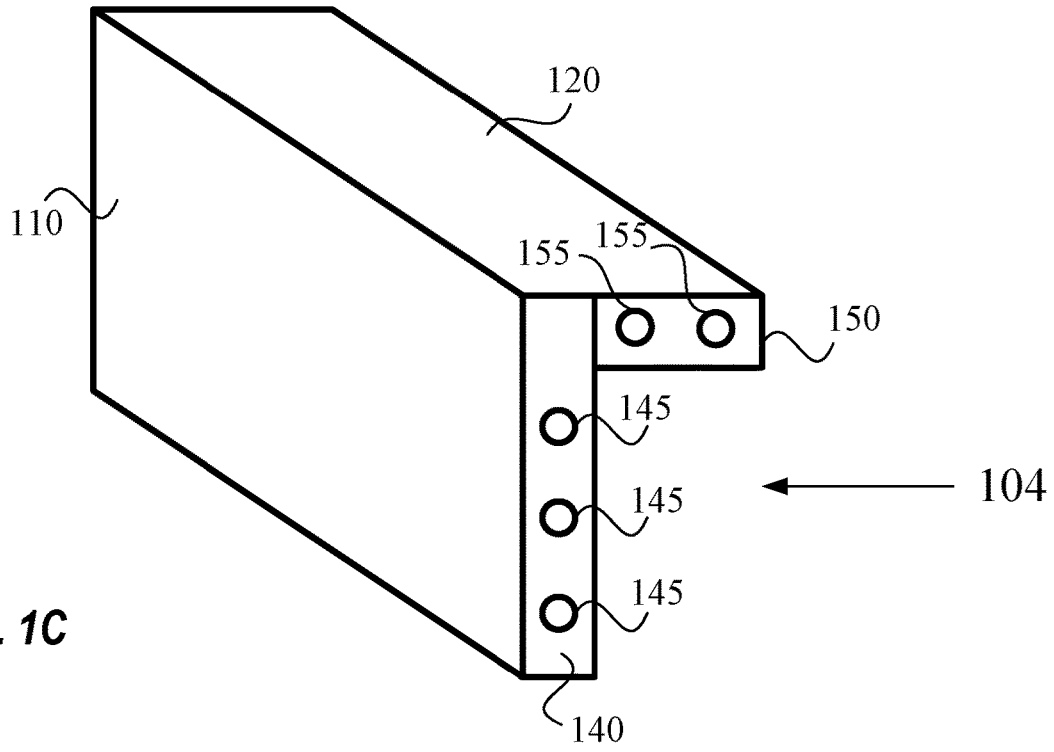

FIG. 1C illustrates a perspective view of an example wall 104. The wall 104 includes a flange 140 extending from a side of the side wall 110 (e.g., substantially perpendicular to the side wall 110). The wall 104 may also include a flange 150 extending from a side of the upper platform 120 (e.g., substantially perpendicular to the upper platform 120). The flanges 140, 150 may be used to secure the walls 104 together. According to one embodiment, one or both of, the flanges 140, 150 may have holes 145, 155 formed therein for enabling, for example, bolts (not illustrated) to be placed therethrough and locked in place with nuts (not illustrated) for the walls 104 to be secured to one another.

Figure 1D:
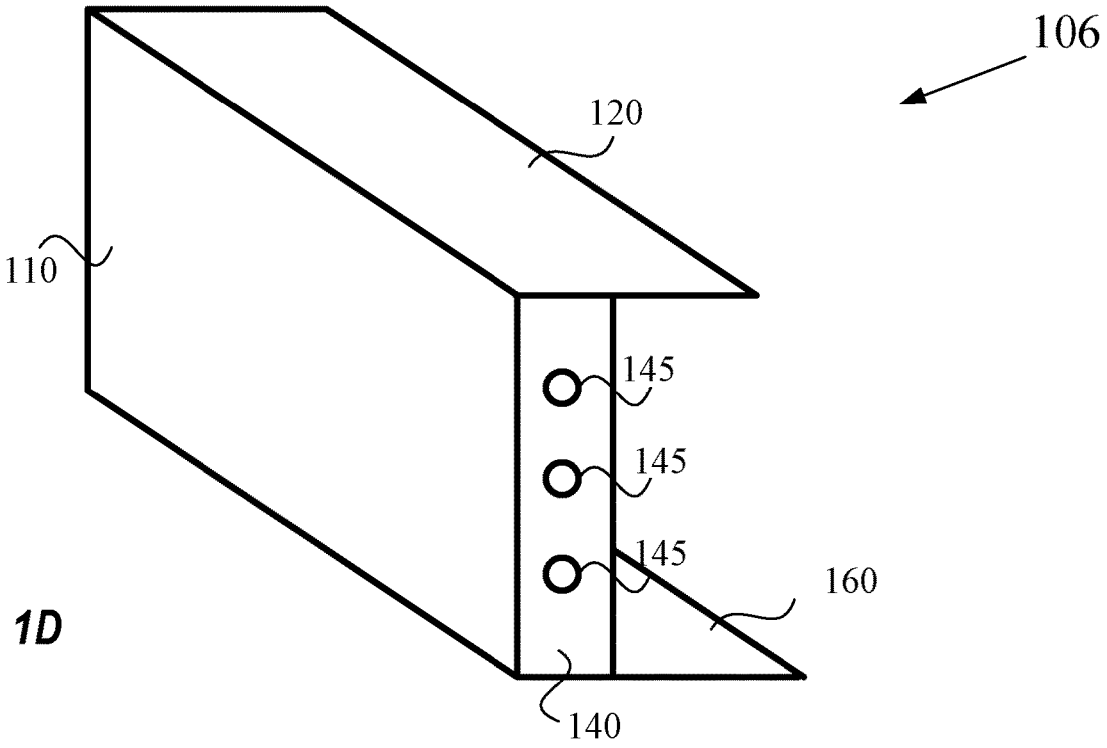

FIG. 1D illustrates a perspective view of an example wall 106. The wall 106 includes a lower platform 160 that extends substantially perpendicular to the side wall 110 (in same direction as the upper platform 120). The lower platform 160 is to be located on the floor of the hole dug to receive the trampoline. The lower platform 160 may abut the sides of the hole and cause the side wall 110 to be located at least a distance equal to length of the lower platform 160 away. When the portion of the hole outside the sidewall 110 is backfilled with dirt, stone or the like the backfill on the lower platform 160 will provide support for the wall 106 and assist in securing the wall 106 in place.

The sidewall 110 includes the flange 140 extending from a side thereof (e.g., substantially perpendicular thereto). The flange 140 may be used to secure the walls 106 together. The flange 140 may include one or more holes 145. According to one embodiment, the flange 140 may have bolts (not illustrated) placed through the holes 145 and locked in place with nuts (not illustrated) for the walls 106 to be secured to one another. According to one embodiment, the upper platform 120 and/or the lower platform 160 may also include flanges (not illustrated).

As illustrated the upper platform 120 and the lower platform 160 have the same configurations (e.g., dimensions). Such a configuration enables the wall 106 to be installed in either direction. The invention is in no way intended to be limited thereto. For example, one platform may have be longer than the other without departing from the current scope.

Figure 1E:
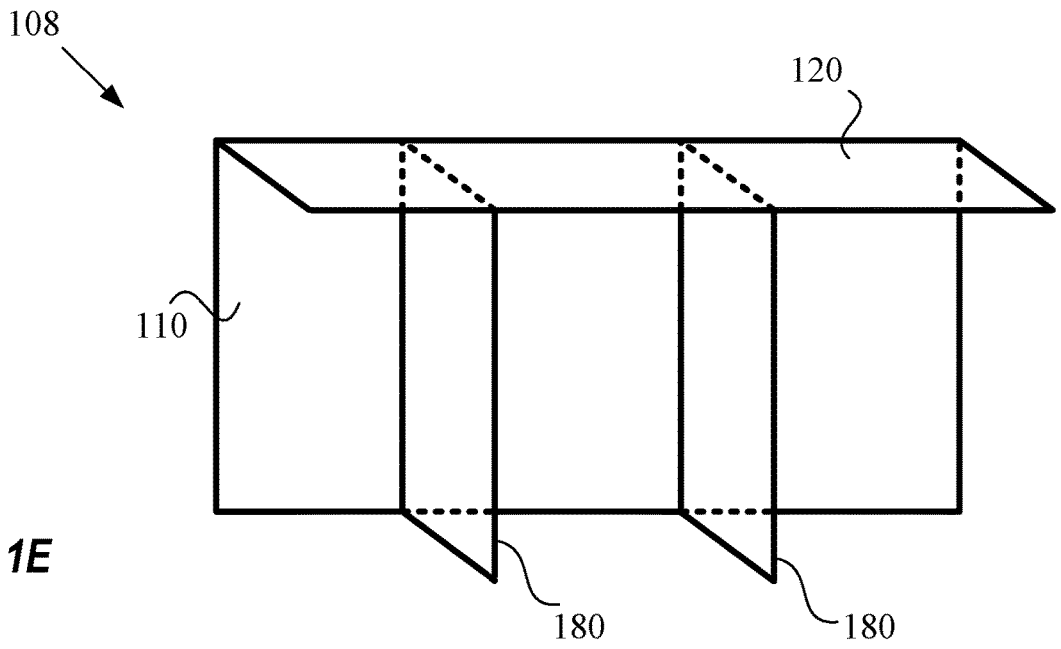

FIG. 1E illustrates a perspective view of an example wall 108. The wall 108 includes support braces 180 that traverse a back of the side wall 110 to provide support for the upper platform 120. The supports 180 may be secured to the side wall 110 via various different means including, but not limited to, screws, welding, and glue. While a lower platform 160 is not illustrated, it may be included and the supports 180 may be located between the upper platform 120 and the lower platform 160.

Figure 1F:
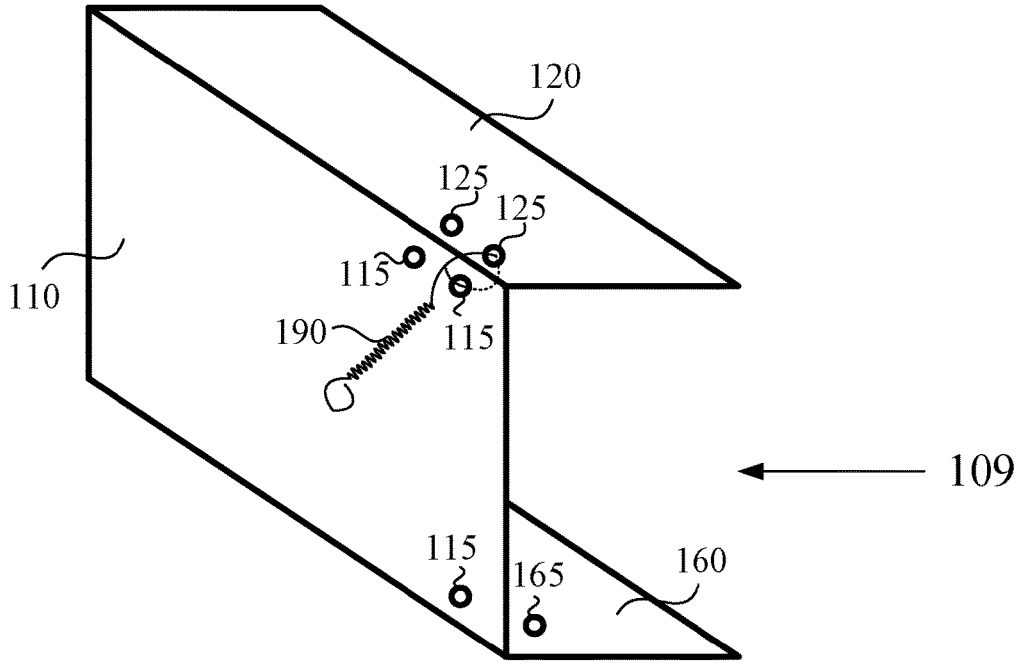

FIG. 1F illustrates a perspective view of an example wall 109. The wall 109 includes holes 125 formed in the upper platform 120 for receiving springs 190. The springs 190 include connectors on each side thereof to connect to the wall 109 and the bounce mat. One connector of the spring 190 may be secured to the wall 109 by placing the connector within the hole 125. According to one embodiment, the side wall 110 may include holes 115 along an upper edge thereof in alignment with the holes 125. The spring 190 may be secured to the wall 109 by placing the connector through both the hole 125 and the hole 115. The holes 125, 115 may be formed in the walls 109 by, for example, drilling or cutting. The holes 125, 115 may be formed in the walls 109 prior to, or after, the walls are appropriately configured (e.g., bent to form the upper platform 120). Connecting the spring to the hole(s) 125, 115 enables the walls 109 to be made out of a single piece of material (e.g., does not require any hooks and/or loops to be connected thereto). It should be noted that for ease of illustration only a few holes 125, 115 and a single spring 190 are illustrated. The holes 125, 115 would be evenly spaced across the entire wall 109 and springs 190 would be located in each.

According to one embodiment, the lower platform 160 may include holes 165 and the side wall may include holes 115 along a lower edge thereof in alignment with the holes 165. Such a configuration, would enable the walls 109 to be installed in either direction.

The invention is not limited to utilizing holes 125, 115, 165 to secure the springs 190. Rather other means, including but not limited to, hooks and rings could be utilized to secure the springs 190 without departing from the current scope.

Figure 2:
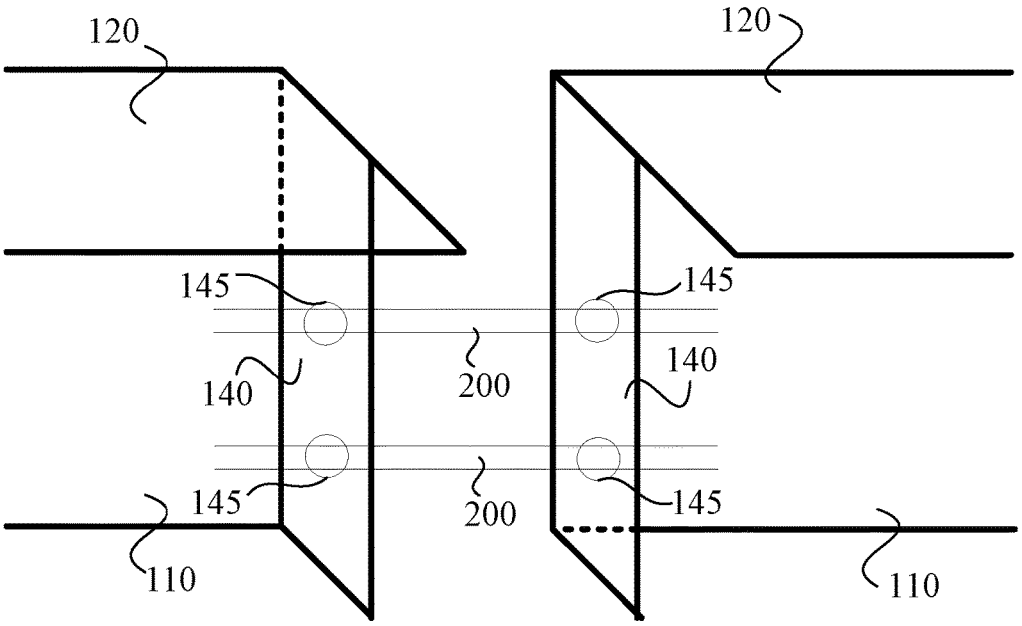
FIG. 2 illustrates a perspective view showing how two adjacent straight walls could be secured to one another, according to one embodiment.

FIG. 2 illustrates a perspective view showing how two adjacent straight walls could be secured to one another. Each of the adjacent walls include a side wall 110, an upper platform 120, and a side flange 140 having a plurality of holes 145 formed therein. The walls are placed so that the side walls 140 abut one another (for ease of illustration they are illustrated separated from one another) with the holes 145 aligned. This configuration should also result in the side walls 110 and the upper platforms 120 being aligned. The walls are secured to one another by placing a connection means (e.g., bolt, screw, clamp, pin) 200 through the aligned holes 145. The connection means 200 may be secured in place in some fashion. For example, a bolt may be secured in place with a nut.

In order to secure perpendicular straight walls to create a corner of a square or rectangular trampoline, a corner piece that includes perpendicular flanges may be required. Each of the perpendicular walls could be secured to an associated flange of the corner piece.

According to one embodiment, rather than utilize perpendicular walls and a corner piece, a corner wall may be formed that includes side walls that are perpendicular to each other.

The walls may come in standard lengths (e.g., 4 feet, 2 feet) that are utilized to create the appropriate size and shape trampoline. Standard corner pieces (e.g., right angles) may be utilized. Alternatively, corner walls of standard lengths (e.g., each wall 2 feet) may be utilized. The walls and the corner pieces (if utilized) may also come in standard heights (e.g., 18 inches, 3 feet).

Figure 3:
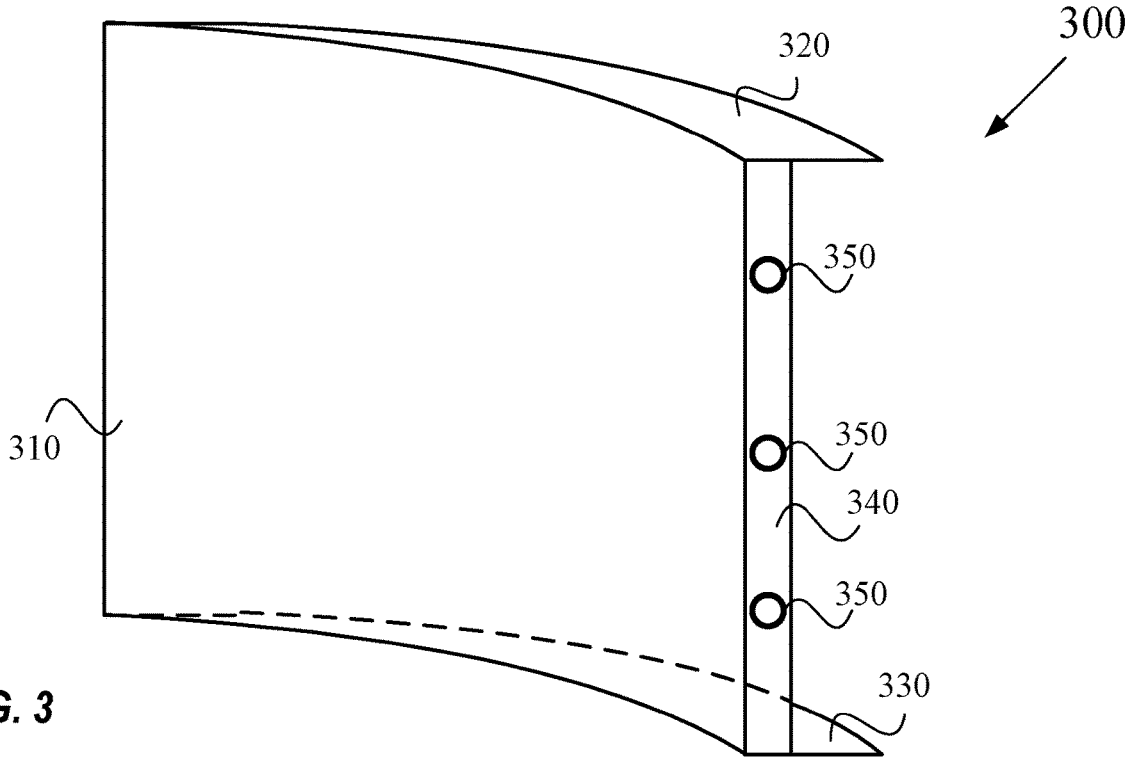
FIG. 3 illustrates a perspective view of an example curved wall, according to one embodiment.

FIG. 3 illustrates a perspective view of an example curved wall 300. The wall 300 includes a main vertical wall (side wall) 310, an upper platform 320, a lower platform 330 and a side flange 340 having a plurality of holes 350 formed therein. Adjacent walls may be connected in similar fashion to that described above with respect to the straight walls (see for example FIG. 2). The curved walls may come in standard lengths (e.g., 4 feet, 2 feet), standard heights (e.g., 18 inches, 3 feet) and be curved at a angle to support a standard radius' (e.g., 6 foot, 7 foot).

Figure 4A:
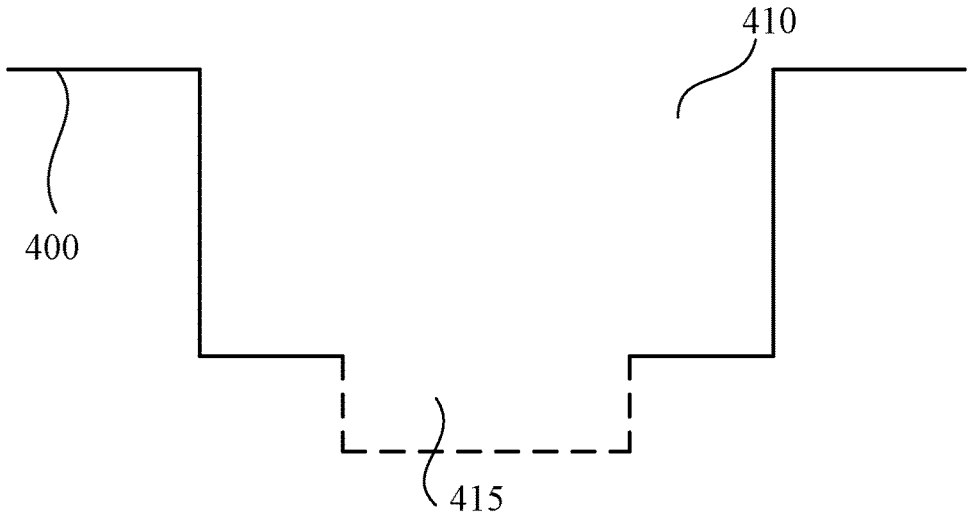
FIGS. 4A-I illustrate cross sectional views of various stages in an example installation process, according to one embodiment.
Figure 4B:
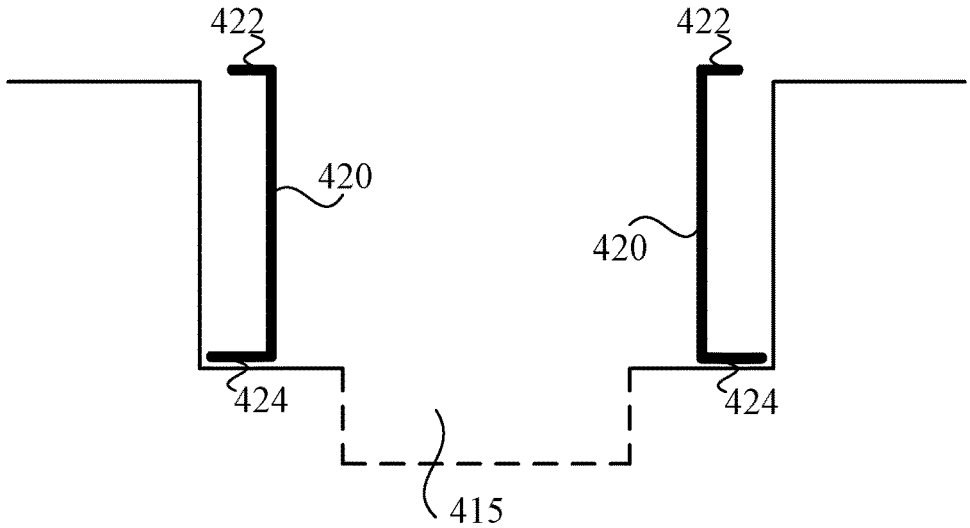

FIGS. 4A-H illustrate cross sectional views of an example installation process. FIG. 4A illustrates an initial step of digging a hole 410 in the ground 400. The hole 410 should be dug slightly larger than the dimensions of the trampoline to be installed therein. The depth of the hole 410 should be greater than the amount of give in the bounce mat. It should be noted that the bounce mat will be capable of flexing more in the middle then it will be on the sides. Accordingly, the center of the hole 415 may be dug deeper than the outsides. Such a configuration enables the walls to be shorter than an above the ground trampoline where the height has to be the same everywhere. FIG. 4B illustrates walls 420 being placed within the hole 410. As illustrated, the walls 420 are located on the shallower part of the hole 410 where the bounce mat is not capable of flexing as much. The deeper part of the hole 415 is located internal to the walls 420. The walls include an upper platform 422 and a lower platform 424.

In order to provide drainage for the hole 410, 415 that the trampoline is located in, the hole 415 (or the hole 410 in configurations where the whole hole is dug to the same depth) may be configured as a permeable drainage bed (seepage pit) that allows water that enters therein to flow therethrough.

Figure 4C:
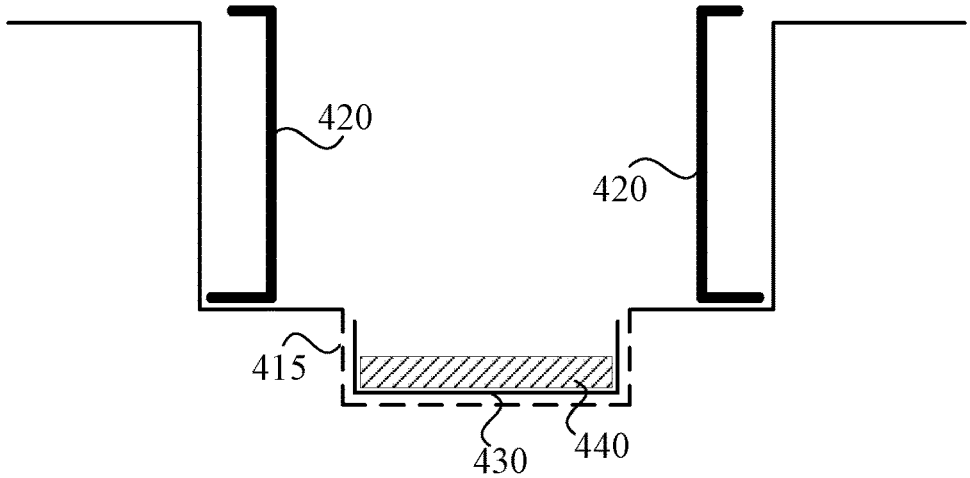

FIG. 4C illustrates a seepage pit being formed in the hole 415. Initially, the hole 415 has filter fabric 430 placed on the ground and then a permeable material (e.g., stones, gravel, ballast) 440 is provided on top of the filter fabric 430. The filter fabric 430 may comprise any material that is sufficiently porous as to allow water or other liquid to seep or drain through into the surrounding earth but not allow dirt or mud to seep therethrough. The purpose of the permeable material 440 is to allow water or other liquid to seep or drain through into the surrounding earth (to provide a seepage pit for water received therewithin). The depth of the permeable material 440 may vary based on the expected amount of water to process and the depth of the seepage pit should be taken into account when determining the depth of the hole. The purpose of the filter fabric 430 is to prevent mud from below the permeable material 440 from entering the permeable material 440 and potentially effecting the operation of the seepage pit. The seepage pit ensures that the water that enters the pit does not result in soil erosion or standing water that may result in rusting of the frame or provide a haven for mosquito's or the like.

Figure 4D:
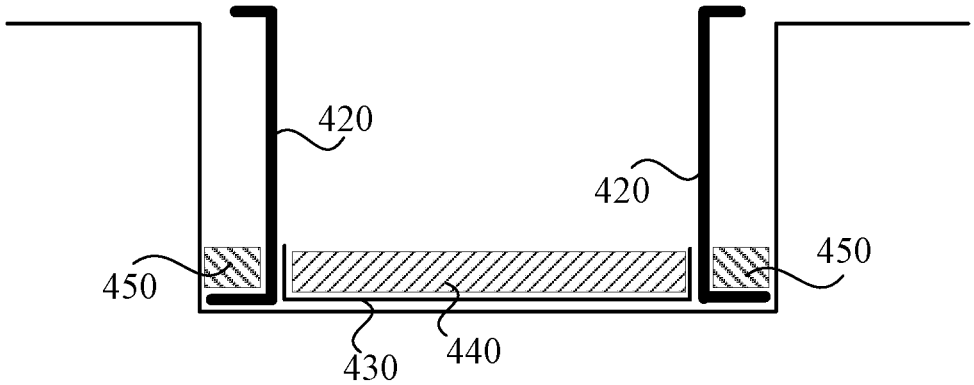

FIG. 4D illustrates a seepage pit being formed in the hole 410. In this embodiment, the hole 410 is the same depth everywhere and the walls 420 are a height required to provide the maximum bounce from the bounce mat (e.g. center of the mat). The filter fabric 430 is placed on the ground in the hole 410 and the permeable material 440 is provided on top of the filter fabric 430. Stone or other heavy material 450 may be provided in the hole 410 external to the walls 420. The purpose of the stone 450 external to the walls 420 is to provide support for the walls 420. For example, the stone on the lower platform of the walls helps secure the walls in an upright position. It should be noted that the stone 450 and the permeable material 440 may be the same or may be different. As illustrated, the depth of the stone 450 and the permeable material 440 is the same but is in no way intended to be limited thereby.

It should be noted that while not illustrated that for larger in the ground trampolines that structural supports (e.g., cross beams) may be located on the ground between opposite walls to provide additional support.

Figure 4E:
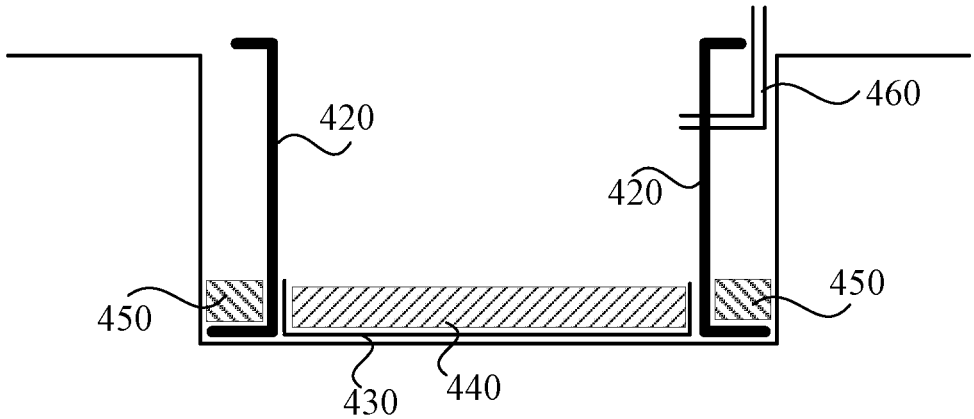

The bounce provided by the bounce mat is at least partially based on the air being capable of being displaced below the bounce mat. Accordingly, some sort of venting should be provided for the in-ground trampoline. FIG. 4E illustrates venting being provided within the hole 410. The venting is provided by cutting a hole (not separately illustrated) in at least one of the walls 420 and securing a pipe 460 thereto. The pipe 460 is configured so as to enable air from the hole 410 to escape to the atmosphere above the ground 400.

The use of the pipe 460 is not the only way to provide venting. Rather, venting may be provided in various different manners without departing from the current scope. For example, venting may be capable of being out the top of the trampoline if the safety pads that are placed over the walls 420 and springs allow airflow. The venting may be provided simply by holes or pervious sections (e.g., screened) in the walls 420 if those portions of the walls 420 are above the ground 400 (for embodiments that may have the bounce mat slightly above ground level) or if the hole/pervious section is surrounded with permeable material (e.g., stones, gravel, ballast) that would allow air to pass therethrough much like it enables water to flow therethrough for the seepage pit.

Figure 4F:
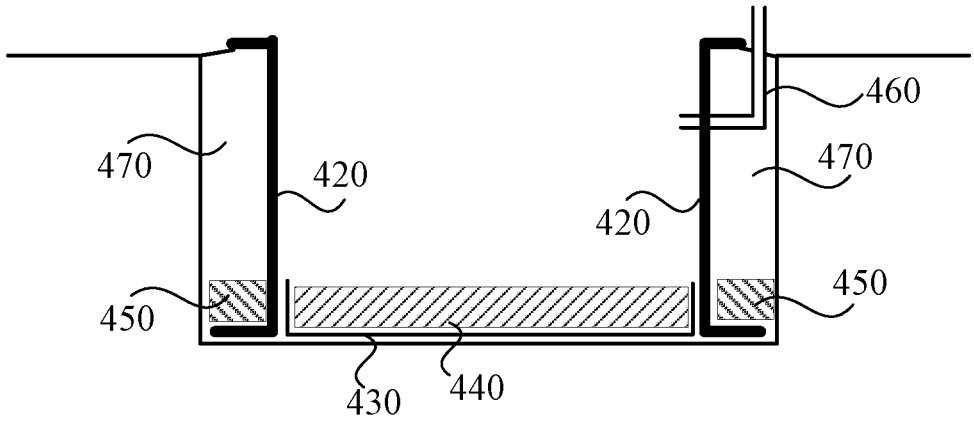

FIG. 4F illustrates the portion of the hole 410 outside of the walls 420 being backfilled with, for example, the soil 470 that was excavated. One of the reasons for over excavating the hole 410 (larger than the frame that is created by the walls 420) is so that the area around the frame can be backfilled to provide support for the frame. According to one embodiment, the excavated soil that is backfilled may provide all the support for the frame. According to one embodiment, as noted above stone 450 may be provided external to the frame and the stone 450 and the excavated soil 470 may provide support for the frame.

Figure 4G:
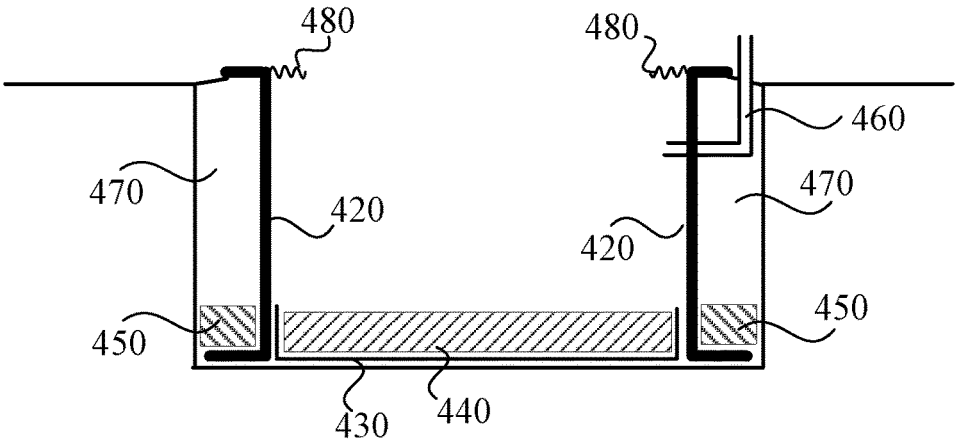
Figure 4H:
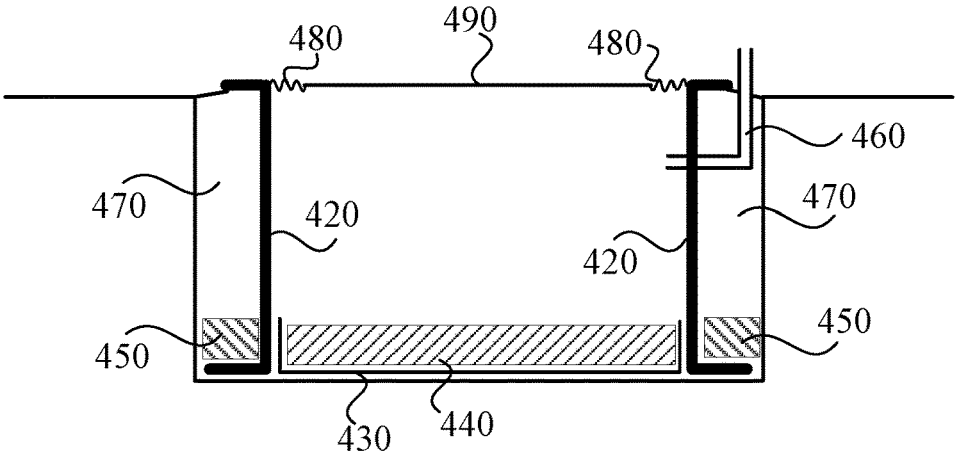

FIG. 4G illustrates the springs 480 being mounted to the walls 420. As noted above, the springs 480 may be mounted to the walls 420 by threading an end of the spring 480 through the holes (not illustrated) in the walls 420. FIG. 4H illustrates the bounce mat 490 being connected to the springs 480. When connected to the plurality of springs 480, the bounce mat 490 becomes taut and is enabled to generate a bouncing force on a user jumping thereon. As one skilled in the art would know, the bounce mat 490 may be comprised of a variety of materials, including, without limitation, polypropylene, or any other material with like qualities of durability, smoothness, and flexibility.

Figure 4I:
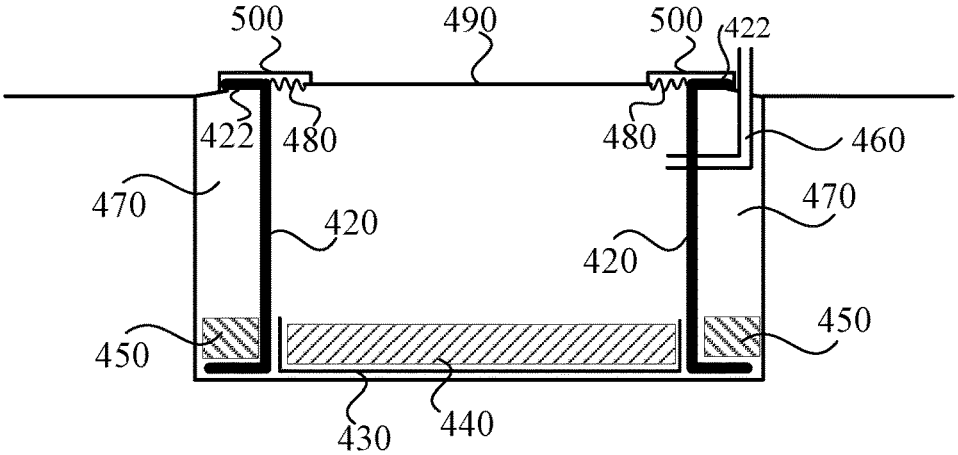

It should be noted that FIGS. 4G and 4H illustrate the springs 480 being connected to the walls 420 prior to the bounce mat 490 but is in no way intended to be limited thereto. Rather, the springs 480 may be connected to the bounce mat 490 first or the springs 480 may be connected to the bounce mat 490 and walls 420 in any order without departing from the current scope. FIG. 4I illustrates the safety pad 500 being placed on the upper platforms 422 of the walls 420 and on the springs 480. The safety pad 500 may be secured to the upper platforms 422 of the walls 420 in a manner that keeps the safety pad 500 in place but enables it to be removed if necessary. According to one embodiment, the safety pads 500 may be secured to the upper platforms 422 of the walls 420 with for example, Velcro®. As one skilled in the art would know, the safety pad 500 may be comprised of a material of sufficient thickness and softness so as to ameliorate possible injury to a user coming into contact with the springs 480 or the upper platforms 422 of the walls 420.

Figure 5:
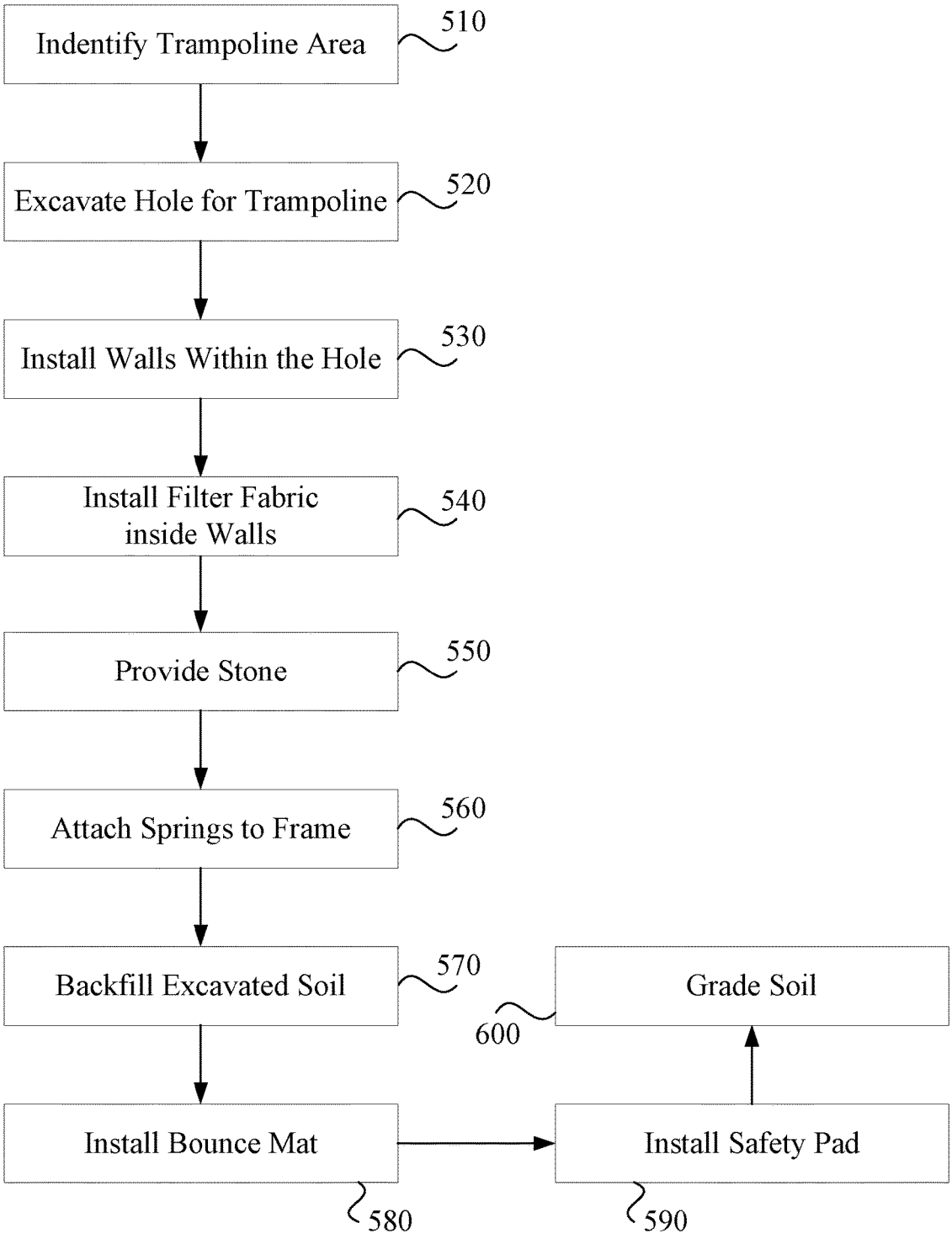
FIG. 5 illustrates a flow chart of an example process for installing an in the ground trampoline, according to one embodiment.

FIG. 5 illustrates an example flow chart for installing an in-ground trampoline. The area where the trampoline is to be installed and the ground to be excavated to create the hole for housing the trampoline is identified 510. The area to be excavated is marked for an area greater than the size of the trampoline. The reason the area to be excavated is identified as being greater that than the size of the trampoline is so that there is sufficient area to install the walls (have access from both sides) and so that after the walls are installed the over excavated area can be backfilled and provide support for the walls.

The identified area is excavated to a depth of the walls (and deeper in the middle for some embodiment) and the floor of the hole created is graded 520. The walls of the trampoline are located in the pit and secured together (e.g., using bolts) to provide the frame and retaining walls 530. It should be noted that the walls of the trampoline will not be abutting the sides of the hole at this point. Filter fabric is provided across the bottom of the hole internal to the walls 540. Stone is provided in the hole internal to the walls on top of the filter fabric 550. The filter fabric and stone create a seepage pit that ensures that the water that enters the hole does not result in soil erosion or standing water that may result in rusting of the frame or provide a haven for mosquito's or the like.

Springs are mounted to the walls 560. The excavated soil is backfilled in the hole around the exterior of the walls (frame) 570. According to one embodiment, the excavated soil that is backfilled may provide all the support for the frame. According to one embodiment, as noted above stone may be provided external to the frame and the stone and the excavated soil may provide support for the frame. A trampoline mat is installed 580. One or more safety pads are installed on the upper platforms of the walls and the springs 590. The soil around the trampoline is then graded and may be seeded 600.

It should be noted that the method is in no way intended to be limited to the exact steps and sequence described above. Rather, steps may be added, removed, combined split apart, and/or rearranged with departing from the current scope.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention. As such, those skilled in the art will appreciate that the conception, upon which this disclosure is based, may readily be utilized as a basis for the designing of other structures, methods, and systems for carrying out the several purposes of the present invention. It is important, therefore, that the claims be regarded as including such equivalent constructions insofar as they do not depart from the spirit and scope of the present invention.

What is claimed is:

1. An in-ground trampoline system, comprising:

a plurality of walls configured to be connected to one another and placed within a hole created beneath a surface of ground to form a frame of a trampoline substantially below the surface of the ground and also provide stability to the hole, wherein the plurality of walls respectively include a lower platform that extends sustainably perpendicular to the respective wall and is configured to face a perimeter of the hole, wherein the lower platforms are backfilled over to provide additional support for the plurality of walls;

a plurality of connection means respectively formed along a top portion of the plurality of walls;

a plurality of springs respectively connected to the plurality of connection means;

a bounce mat configured to be connected to the plurality of springs and to become taut when so connected; and one or more safety pads configured to cover the plurality of springs and an upper edge of each of the plurality of walls.

2. The system of claim 1, further comprising a permeable drainage bed formed in a bottom of the hole internal to the plurality of walls.

3. The system of claim 2, wherein the permeable drainage bed is comprised of a filter fabric and a plurality of stones, wherein the filter fabric and plurality of stones are layered onto the bottom of the hole.

4. The system of claim 2, wherein the hole has a first depth that the plurality of walls sit on and a second depth internal to the plurality of walls, wherein the permeable drainage bed is formed at the second depth of the hole.

5. The system of claim 1, wherein the plurality of walls are made of materials that provide appropriate sturdiness and are resistant to corrosion, wear, and rust.

6. The system of claim 5, wherein the plurality of walls are made of metal.

7. The system of claim 5, wherein the plurality of walls are made of stainless steel.

8. The system of claim 1, wherein the lower platform is backfilled over with excavated soil.

9. The system of claim 1, wherein the lower platform is backfilled over with stone and excavated soil.

10. The system of claim 1, wherein the plurality of connection means includes at least one aperture formed in the upper edges of the plurality of walls, respectively, that the plurality of springs are respectively secured to.

11. The system of claim 1, wherein the plurality of walls respectively include side flanges that are utilized to secure the plurality of walls to each other.

12. A method for installing an in-ground trampoline, comprising:

digging a hole to a defined depth and area;

inserting a plurality of walls into the hole and connecting the plurality of walls to one another in order to form a trampoline frame and to provide support for the hole, wherein the plurality of walls respectively include a lower platform that extends external to the respective wall;

backfilling around the plurality of walls so as to cover the lower platforms to provide support for the plurality of walls;

attaching a plurality of springs to upper edges of the plurality of walls, respectively;

affixing a bounce mat to the plurality of springs, wherein the bounce mat is configured to become taut when so affixed; and connecting one or more safety pads to the upper edges of the plurality of walls in order to cover the plurality of springs and the upper edges of the plurality of walls.

13. The method of claim 12, further comprising providing a permeable drainage bed across a floor of the hole internal to the plurality of walls.

14. The method of claim 13, wherein the providing the permeable drainage bed includes laying a filter fabric onto the floor of the hole and laying a plurality of stones onto the filter fabric.

15. The method of claim 13, wherein:

the defined depth and area comprises an outer depth of the hole and an inner depth of the hole that is deeper than the outer depth of the hole;

the inserting the plurality of walls includes inserting the plurality of walls on the outer depth of the hole; and the providing the permeable drainage bed includes providing the permeable drainage bed at the inner depth of the hole.

16. An in-ground trampoline drainage system, comprising:

a plurality of walls configured to be placed within a hole and connected to one another to form a frame of a trampoline substantially below a surface of ground wherein the hole is formed, wherein the plurality of walls also provide stability to the hole, and wherein the plurality of walls respectively include a lower platform that extends external to the respective wall and is backfilled over to provide additional support therefore;

a permeable drainage bed comprising a filter fabric and a plurality of stones layered across a bottom of the hole inside of the plurality of walls;

a plurality of springs respectively configured to be connected to upper edges of the plurality of walls, respectively;

a bounce mat configured to be connected to the plurality of springs and to become taut when so connected; and one or more safety pads configured to be connected to the upper edges of the plurality of walls, wherein the one or more safety pads are positioned to cover the plurality of springs and the upper edges of the plurality of walls.

17. The system of claim 16, wherein the hole has a first depth that the plurality of walls sit on and a second depth internal to the plurality of walls, wherein the permeable drainage bed is formed at the second depth of the hole.

* * * * *